US008468627B2

(12) United States Patent
Leach

(10) Patent No.: US 8,468,627 B2
(45) Date of Patent: Jun. 25, 2013

(54) ELONGATED ANGULAR MULTIPLE POSITION BODY PILLOW

(76) Inventor: Jamie S. Leach, Ada, OK (US)

( * ) Notice: Subject to any disclaimer, the term of this patent is extended or adjusted under 35 U.S.C. 154(b) by 962 days.

(21) Appl. No.: 11/324,387

(22) Filed: Jan. 4, 2006

(65) Prior Publication Data

US 2007/0151031 A1 Jul. 5, 2007

(51) Int. Cl.
*A47G 9/00* (2006.01)

(52) U.S. Cl.
USPC ..... 5/632; 5/630; 5/652

(58) Field of Classification Search
USPC ..... 5/632, 652, 630
See application file for complete search history.

(56) References Cited

U.S. PATENT DOCUMENTS

| | | | |
|---|---|---|---|
| 395,043 | A | 12/1888 | Doremus |
| 416,970 | A | 12/1889 | Taylor |
| 726,164 | A | 4/1903 | Hogan et al. |
| 909,453 | A | 1/1909 | Pullman |
| 1,376,625 | A | 5/1921 | Johnston |
| 1,447,288 | A | 3/1923 | Emmerich |
| 1,577,586 | A | 3/1926 | Morehouse |
| 1,769,722 | A | 7/1930 | Sutton |
| 2,149,140 | A | 2/1939 | Gonzalez-Rincones |
| D124,296 | S | 12/1940 | Thompson |
| 2,279,867 | A | 4/1942 | Falk |
| 2,328,871 | A | 9/1943 | Woehler |
| 2,336,707 | A | 12/1943 | Thompson |
| 2,404,108 | A | 7/1946 | Stauffacher et al. |
| 2,404,505 | A | 7/1946 | Knecht |
| 2,429,350 | A | 10/1947 | Farrand |
| 2,451,007 | A | 10/1948 | White |
| 2,495,482 | A | 1/1950 | Rogatz |
| 2,502,486 | A | 4/1950 | Savrin |
| 2,544,896 | A | 3/1951 | Nidetch et al. |
| D162,858 | S | 4/1951 | McGlinchey |
| 2,626,407 | A | 1/1953 | Kurry |
| 2,652,183 | A | 9/1953 | Hlivka |
| 2,694,202 | A | 11/1954 | Macrides |
| 2,694,204 | A | 11/1954 | Cross |
| 2,741,412 | A | 4/1956 | Hinkle |
| 2,795,802 | A | 6/1957 | Myers |
| 2,817,090 | A | 12/1957 | Toellner |
| 2,857,957 | A | 10/1958 | Gay |
| 2,880,424 | A | 4/1959 | Kalensky |
| D191,513 | S | 10/1961 | Kerr |

(Continued)

FOREIGN PATENT DOCUMENTS

| | | |
|---|---|---|
| JP | 20041949989 | 7/2004 |
| WO | PCT/US01/270868 A1 | 3/2002 |

OTHER PUBLICATIONS

Abstract, JP 2004 194989, Jul. 15, 2004, ESPACENET.

*Primary Examiner* — William Kelleher
(74) *Attorney, Agent, or Firm* — Mary M. Lee

(57) ABSTRACT

An elongated angular multiple position body pillow embodying an enlarged center section having a curved top portion and a substantially straight base, two arms extending longitudinally from the center section and at an adjustable angle thereto, the terminal ends of each arm being provided with one half of a fabric tie which fabric ties, when brought into contact with one another, cause the pillow to be temporarily fixed in a semi-toroidal shape, the elongated angular multiple position body pillow being adapted to support a user when the user is lying on her side, in a seated position, reclining with her back elevated, or nursing an infant.

26 Claims, 4 Drawing Sheets

U.S. PATENT DOCUMENTS

| | | | | |
|---|---|---|---|---|
| 3,088,438 | A | | 5/1963 | Oliphant |
| D201,492 | S | | 6/1965 | Jacobson |
| 3,239,271 | A | | 3/1966 | Bergersen |
| 3,298,035 | A | | 1/1967 | Gobins |
| 3,327,330 | A | * | 6/1967 | Mccullough ..... 5/640 |
| 3,392,737 | A | | 7/1968 | Fefferman |
| 3,604,026 | A | | 9/1971 | Scheips |
| 3,604,750 | A | | 9/1971 | Doering |
| 3,671,977 | A | | 6/1972 | Degnon |
| 3,713,692 | A | | 1/1973 | McCracken et al. |
| D227,423 | S | | 6/1973 | Ando |
| 3,773,287 | A | | 11/1973 | Hechinger |
| D230,804 | S | | 3/1974 | Lijewski |
| 3,840,916 | A | | 10/1974 | Jennings |
| 3,848,281 | A | | 11/1974 | Mathews |
| 3,899,210 | A | | 8/1975 | Samhammer et al. |
| 3,899,797 | A | | 8/1975 | Gunst |
| 3,911,512 | A | | 10/1975 | Plate |
| D244,569 | S | | 6/1977 | Laroye |
| 4,031,567 | A | | 6/1977 | Planck |
| 4,037,764 | A | | 7/1977 | Almosnino et al. |
| 4,050,737 | A | | 9/1977 | Jordan |
| 4,173,048 | A | | 11/1979 | Varaney |
| 4,194,254 | A | | 3/1980 | Torrez |
| 4,197,604 | A | | 4/1980 | Nakamura |
| 4,227,270 | A | | 10/1980 | Rivera |
| 4,235,474 | A | | 11/1980 | Rosenberg |
| 4,236,264 | A | | 12/1980 | Britzman |
| D259,902 | S | | 7/1981 | Rock |
| 4,287,542 | A | | 9/1981 | Okuda |
| D265,027 | S | | 6/1982 | Meyers |
| D266,800 | S | | 11/1982 | Kula et al. |
| 4,383,713 | A | | 5/1983 | Roston |
| 4,393,530 | A | | 7/1983 | Stark |
| 4,428,514 | A | | 1/1984 | Elf |
| 4,434,920 | A | | 3/1984 | Moore |
| 4,506,396 | A | | 3/1985 | Ritchie, Jr. et al. |
| 4,550,459 | A | | 11/1985 | Endel et al. |
| 4,574,412 | A | | 3/1986 | Smith |
| D284,220 | S | | 6/1986 | Pote |
| 4,592,589 | A | | 6/1986 | Hellwig |
| 4,606,078 | A | | 8/1986 | Tkacsik |
| 4,606,087 | A | | 8/1986 | Alivizatos |
| 4,624,021 | A | | 11/1986 | Hofstetter |
| 4,654,907 | A | | 4/1987 | Haugaard |
| 4,666,017 | A | | 5/1987 | Zimmerman |
| 4,667,624 | A | | 5/1987 | Smith |
| 4,670,923 | A | | 6/1987 | Gabriel et al. |
| 4,676,198 | A | | 6/1987 | Murray |
| 4,676,554 | A | | 6/1987 | Harlick et al. |
| 4,685,163 | A | | 8/1987 | Quillen et al. |
| 4,698,862 | A | | 10/1987 | Mairs |
| 4,709,430 | A | | 12/1987 | Nicoll |
| 4,712,258 | A | | 12/1987 | Eves |
| 4,731,890 | A | | 3/1988 | Roberts |
| 4,754,509 | A | | 7/1988 | Pollard |
| 4,754,510 | A | | 7/1988 | King |
| 4,757,925 | A | | 7/1988 | Knittel |
| 4,763,369 | A | | 8/1988 | Spector |
| 4,788,726 | A | | 12/1988 | Rafalko |
| 4,790,035 | A | | 12/1988 | Whyte |
| 4,794,657 | A | | 1/1989 | Avery |
| 4,796,315 | A | | 1/1989 | Crew |
| D299,988 | S | | 2/1989 | Parabita |
| 4,827,542 | A | | 5/1989 | Kurtenbach |
| 4,834,459 | A | | 5/1989 | Leach |
| 4,836,605 | A | | 6/1989 | Greenwood et al. |
| 4,840,144 | A | | 6/1989 | Voorhees et al. |
| 4,850,144 | A | | 7/1989 | Grisham et al. |
| 4,853,994 | A | | 8/1989 | Ekstein |
| 4,861,109 | A | | 8/1989 | Leach |
| D303,897 | S | | 10/1989 | Phillips |
| 4,871,210 | A | | 10/1989 | Alexander et al. |
| 4,901,384 | A | | 2/1990 | Eary |
| D306,948 | S | | 4/1990 | Zollinger |
| D308,788 | S | | 6/1990 | Boehm |
| D309,018 | S | | 7/1990 | Leach |
| D310,609 | S | | 9/1990 | Burkhardt |
| D313,141 | S | | 12/1990 | Witter et al. |
| 4,980,937 | A | | 1/1991 | Mason et al. |
| 4,986,458 | A | | 1/1991 | Linday |
| 4,996,734 | A | | 3/1991 | Rowe |
| 4,999,863 | A | | 3/1991 | Kane |
| 4,999,866 | A | | 3/1991 | Lindsey |
| 5,026,315 | A | | 6/1991 | Chap |
| D318,202 | S | | 7/1991 | Weber |
| 5,035,013 | A | | 7/1991 | Bloom |
| D318,969 | S | | 8/1991 | Byrn |
| 5,048,136 | A | | 9/1991 | Popitz |
| 5,088,141 | A | | 2/1992 | Meyer et al. |
| 5,097,551 | A | | 3/1992 | Smith |
| 5,103,514 | A | | 4/1992 | Leach |
| 5,109,557 | A | | 5/1992 | Koy et al. |
| 5,115,524 | A | | 5/1992 | Antosko |
| 5,119,767 | A | | 6/1992 | Jimenez |
| 5,131,260 | A | | 7/1992 | Brand et al. |
| 5,154,649 | A | | 10/1992 | Pender |
| 5,159,727 | A | | 11/1992 | McCracken |
| 5,165,130 | A | | 11/1992 | Wendling |
| 5,178,309 | A | | 1/1993 | Bicheler et al. |
| 5,179,741 | A | | 1/1993 | Book |
| D332,865 | S | | 2/1993 | Wilmink |
| 5,187,309 | A | | 2/1993 | Esch et al. |
| 5,193,238 | A | | 3/1993 | Clute |
| 5,216,772 | A | | 6/1993 | Clute |
| D339,923 | S | | 10/1993 | Clarke |
| 5,249,308 | A | | 10/1993 | Blume |
| 5,261,134 | A | | 11/1993 | Matthews |
| D342,615 | S | | 12/1993 | Asher |
| 5,269,323 | A | | 12/1993 | Krouskop |
| 5,272,780 | A | | 12/1993 | Clute |
| 5,310,245 | A | | 5/1994 | Lyszczasz |
| 5,325,818 | A | | 7/1994 | Leach |
| 5,339,472 | A | | 8/1994 | Yin |
| 5,341,531 | A | | 8/1994 | Straub et al. |
| 5,363,524 | A | | 11/1994 | Lang |
| 5,365,613 | A | | 11/1994 | Henegan |
| 5,371,909 | A | | 12/1994 | McCarty |
| D355,306 | S | | 2/1995 | Moses |
| 5,439,008 | A | | 8/1995 | Bowman |
| D365,241 | S | | 12/1995 | Braden et al. |
| 5,473,785 | A | | 12/1995 | Lager et al. |
| D366,368 | S | | 1/1996 | McCarthy |
| 5,490,528 | A | | 2/1996 | Day |
| D369,054 | S | | 4/1996 | Straub et al. |
| D369,934 | S | | 5/1996 | Straub et al. |
| 5,519,906 | A | | 5/1996 | Fanto-Chan |
| D370,585 | S | | 6/1996 | Faithfull |
| 5,522,528 | A | | 6/1996 | Petricola |
| 5,546,620 | A | | 8/1996 | Matthews |
| 5,551,109 | A | | 9/1996 | Tingley et al. |
| D375,557 | S | | 11/1996 | Dixon |
| 5,570,823 | A | | 11/1996 | Lindy |
| 5,572,753 | A | | 11/1996 | Ruscitto |
| 5,581,833 | A | | 12/1996 | Zenoff |
| 5,586,351 | A | | 12/1996 | Ive |
| D377,423 | S | | 1/1997 | Latrella et al. |
| D377,881 | S | | 2/1997 | Watt |
| 5,621,919 | A | | 4/1997 | Graham |
| 5,647,076 | A | | 7/1997 | Gearhart |
| D381,790 | S | | 8/1997 | Harris et al. |
| D382,435 | S | | 8/1997 | Schaffner et al. |
| 5,661,861 | A | | 9/1997 | Matthews |
| 5,664,271 | A | | 9/1997 | Bellavance |
| 5,685,016 | A | | 11/1997 | Douglas |
| 5,699,569 | A | | 12/1997 | Schwarz-Zohrer |
| D388,589 | S | | 1/1998 | Walker |
| 5,708,982 | A | | 1/1998 | Armani |
| 5,778,470 | A | | 7/1998 | Haider |
| 5,813,066 | A | | 9/1998 | Gebhard et al. |
| 5,826,287 | A | | 10/1998 | Tandrup |
| 5,857,598 | A | | 1/1999 | Dunne |
| D408,676 | S | | 4/1999 | Straub et al. |
| D409,038 | S | | 5/1999 | Rojas, Jr. et al. |
| D412,234 | S | | 7/1999 | Cox |
| 5,930,854 | A | | 8/1999 | O'Neill et al. |
| D413,751 | S | | 9/1999 | Alyea |

5,946,725 A 9/1999 Shatzkin et al.
5,950,887 A 9/1999 Powell
D414,915 S 10/1999 Anderson
D416,745 S 11/1999 Noyes
5,978,990 A 11/1999 Akey
5,979,981 A 11/1999 Dunne et al.
5,987,674 A 11/1999 Schaffner et al.
D419,819 S 2/2000 Bartoli
D420,845 S 2/2000 Rumage
6,026,525 A 2/2000 Davis
6,038,720 A 3/2000 Matthews et al.
6,049,929 A 4/2000 Rawson
6,052,848 A 4/2000 Kelly
6,055,687 A 5/2000 Matthews
6,061,854 A 5/2000 Crowley
6,065,655 A 5/2000 Parewick
6,079,067 A 6/2000 Becker et al.
6,088,854 A 7/2000 Brownrigg
6,112,960 A 9/2000 Seering et al.
6,119,873 A 9/2000 Matthews
6,123,389 A 9/2000 O'Connor et al.
D431,745 S 10/2000 Jackson
6,141,805 A 11/2000 Fisher-Cohen et al.
6,205,600 B1 3/2001 Sedlack
6,213,362 B1 4/2001 Lorenzini et al.
D443,461 S 6/2001 Hall et al.
D444,981 S 7/2001 Hall et al.
D445,506 S 7/2001 Vinson et al.
D446,675 S 8/2001 Straub
6,279,185 B1 8/2001 Matthews
D447,376 S 9/2001 Kramer
D450,517 S 11/2001 Darling et al.
D453,653 S 2/2002 Tunnell
6,343,727 B1 2/2002 Leach
6,349,437 B1 2/2002 Horning
6,354,665 B1 3/2002 Ross
6,408,463 B1 6/2002 Palacio
6,412,128 B1 7/2002 Matthews
6,427,251 B1 8/2002 Leach
6,434,769 B1 8/2002 Koenig
6,434,770 B2 8/2002 Matthews-Brown
6,453,493 B1 9/2002 Matthews-Brown
6,457,195 B1 10/2002 Holste
6,463,608 B1 10/2002 Moe
6,484,337 B1 11/2002 Moe et al.
D467,117 S 12/2002 Guy
6,499,164 B1 12/2002 Leach
6,499,165 B1 12/2002 Morgillo
6,505,366 B1 1/2003 Lied
6,532,612 B2 3/2003 Matthews-Brown
6,539,567 B1 4/2003 Bae
6,553,590 B1 4/2003 Leach
6,574,810 B2 6/2003 Mangiaracina
6,601,252 B1 8/2003 Leach
6,625,828 B2 9/2003 Matthews-Brown
6,640,977 B2 11/2003 Matthews-Brown et al.
6,658,681 B2 12/2003 Britto et al.
6,662,390 B1 12/2003 Berger
6,671,907 B1 1/2004 Zuberi
6,671,908 B2 1/2004 Brown et al.
6,685,024 B1 2/2004 Matthews
6,692,072 B2 2/2004 Nelson et al.
6,708,354 B1 3/2004 Carter et al.
6,711,770 B1 3/2004 Owens et al.
6,751,817 B1 6/2004 Leach
D492,533 S 7/2004 Cole
6,760,934 B1 7/2004 Leach
6,763,539 B1 7/2004 Bartley et al.
D493,964 S 8/2004 Low
6,802,092 B1 10/2004 Klein
6,814,405 B2 11/2004 Norman
6,851,143 B2 2/2005 Matthews Brown
6,857,150 B2 2/2005 Matthews Brown et al.
D503,063 S 3/2005 Bartle et al.
6,874,183 B1 4/2005 Taylor
6,892,406 B2 5/2005 Littlehorn
6,905,169 B1 6/2005 Donoghue
6,920,655 B2 7/2005 Mitchell
6,944,898 B2 9/2005 Matthews Brown et al.
7,000,273 B2 2/2006 Rivera-Wienhold et al.
7,000,274 B2 2/2006 Matthews Brown et al.
7,000,275 B2 2/2006 Matthews Brown et al.
7,000,766 B2 2/2006 Matthews Brown et al.
7,010,821 B1 3/2006 Leach
7,017,212 B2 3/2006 Matthews Brown
D518,989 S 4/2006 Clapp
7,055,196 B2 6/2006 Littlehorn
7,089,639 B2 8/2006 Matthews Brown et al.
7,114,206 B2 10/2006 Leach
7,127,760 B2 10/2006 Bartley et al.
7,131,156 B1 11/2006 Walker-Craft
7,146,663 B2 12/2006 Brown et al.
2002/0029422 A1 3/2002 Matthews
2004/0060116 A1 4/2004 Matthews-Brown
2005/0210591 A1 9/2005 Mead et al.
2006/0031992 A1 2/2006 Moore
2007/0022526 A1 2/2007 Leach
2007/0028384 A1 2/2007 Leach
2007/0046084 A1 3/2007 Leach
2007/0151031 A1 7/2007 Leach

* cited by examiner

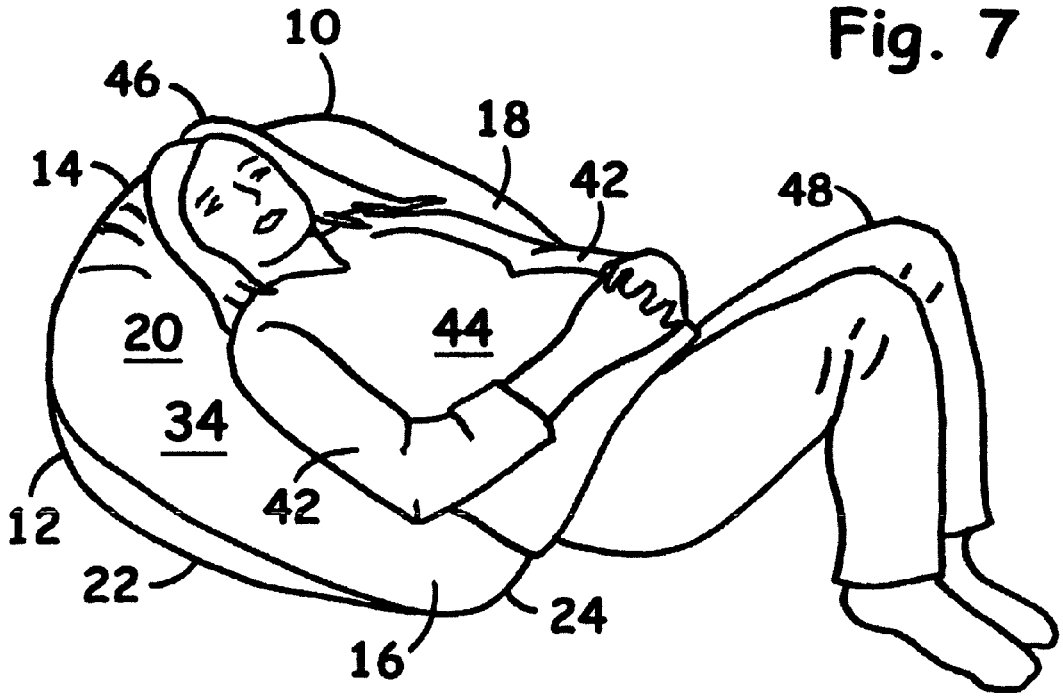
Fig. 7
Fig. 8
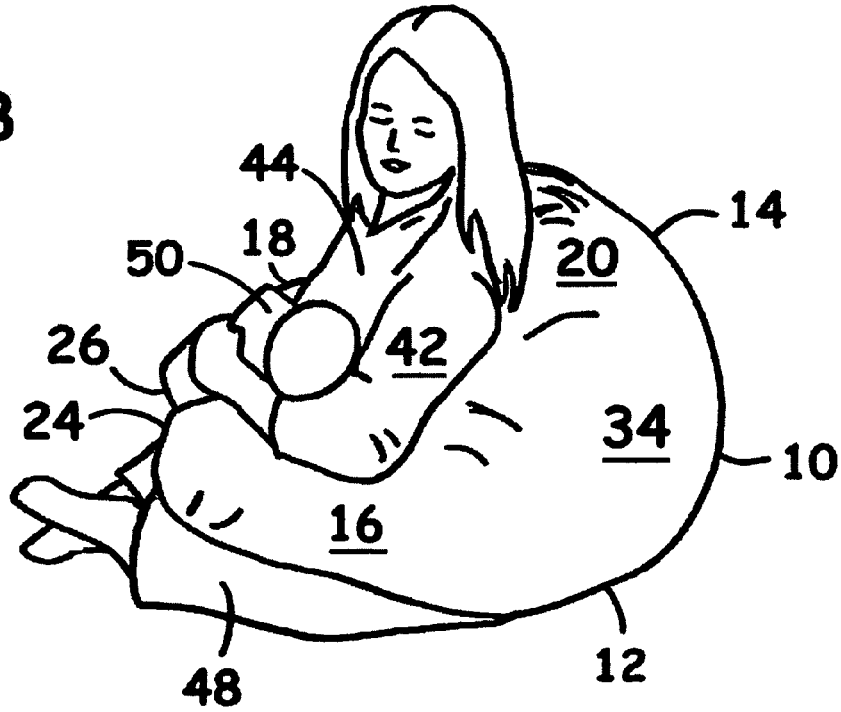

ELONGATED ANGULAR MULTIPLE POSITION BODY PILLOW

BACKGROUND OF THE INVENTION

1. Field of the Invention

The present invention relates to an elongated angular multiple position body pillow. More particularly, the present invention is an elongated angular pillow having three sections as follows: an enlarged center section having a curved top portion and a substantially straight base, and two arms extending longitudinally from the center section and at an adjustable angle thereto to provide a plurality of positions to support a user when the user is lying on her side, in a seated position, with her back elevated, with her legs elevated, or nursing an infant, the ends of each arm being provided with one half of a fabric "tie" so that, when brought into contact with one another, the "ties" affixed to the arms may be tied together and hold the pillow in a semi-toroidal shape.

2. Prior Art

There are a number of patents that show or relate to body pillows and support devices. Although the field of art relating to curved, sectional support pillows having an enlarged central section is crowded, it is believed to be novel to provide an elongated angular body pillow having an enlarged central section provided with a curved top portion and a substantially straight base and a first end and a second end, with an arm extending longitudinally from the first end and second end of the enlarged central section, each arm being adjustable to create greater support to a user, each arm being provided with a tie at the respective end thereof to facilitate a secure means of positioning the elongated angular body pillow in a semi-toroidal embodiment or releasing the body pillow into a full-length embodiment to permit a plurality of positions for optimal comfort and convenience for a user. A preliminary patentability search was conducted on this invention and the following listed references were uncovered in the search.

| Pat. No. | Inventor | Issue Date |
|---|---|---|
| Des. 365,241 | Braden et al. | Dec. 19, 1995 |
| D453,653 S | Tunnell | Feb. 19, 2002 |
| 4,173,048 | Varaney | Nov. 6, 1979 |
| 4,624,021 | Hofstetter | Nov. 25, 1986 |
| 4,731,890 | Roberts | Mar. 22, 1988 |
| 5,097,551 | Smith | Mar. 24, 1992 |
| 5,519,906 | Fanto-Chan | May 28, 1996 |
| 5,987,674 | Schaffner et al. | Nov. 23, 1999 |
| 6,052,848 | Kelly | Apr. 25, 2000 |
| 6,088,854 | Brownrigg | Jul. 18, 2000 |
| 6,466,164B1 | Leach | Dec. 31, 2002 |
| 6,601,252B1 | Leach | Aug. 5, 2003 |
| 6,708,354B1 | Carter et al. | Mar. 23, 2004 |
| 6,751,817 | Leach | Jun. 22, 2004 |
| 6,463,608B1 | Moe | Oct. 15, 2002 |
| 5,987,990 | Akey | Nov. 9, 1999 |
| 5,519,906 | Fanto-Chan | May 28, 1996 |
| 6,052,848 | Kelly | Apr. 25, 2000 |
| 5,664,271 | Bellavance | Sep. 9, 1997 |
| 5,269,323 | Krouskop | Dec. 14, 1993 |
| 5,154,649 | Pender | Oct. 13, 1992 |
| 5,097,551 | Smith | Mar. 24, 1992 |
| 4,794,657 | Avery | Jan. 3, 1989 |
| 4,754,510 | King | Jul. 5, 1988 |
| 4,624,021 | Hofstetter | Nov. 25, 1986 |
| 4,506,396 | Ritchie, Jr., et al. | Mar. 26, 1985 |
| Des. 377,881 | Watt | Feb. 11, 1997 |
| Des. 365,241 | Braden, et al. | Dec. 19, 1995 |
| Des. 308,788 | Boehm | Jun. 26, 1990 |
| Des. 230,804 | Lijewski | Mar. 19, 1974 |

The above patents are not considered to be particularly pertinent to the present invention.

Moe U.S. Pat. No. 6,463,608 discloses a multi-purpose pillow with hand warming muff comprising a C-shaped pillow provided with a toggle and loop at terminal ends thereof so that the ends may be connected to keep the pillow in place around the user. When the pillow is fastened at the back of the user, a hand warmer which is sewn into the main portion of the pillow may be employed by the user slipping his or her hands through open ends on either side of the hand warmer. The Moe patent does not appear to be extendable to a substantially straight position whereby the body of a user in a reclining or sleeping position could be accommodated.

Akey U.S. Pat. No. 5,978,990 discloses a comfort maternity pillow comprising a rectangular pillow having two arms extending therefrom to form a sort of pear shape having a central opening therein.

Fanto-Chan U.S. Pat. No. 5,519,906 discloses a horseshoe shaped pillow having two legs extending therefrom, the terminal ends of the legs being provided with a hook-and-loop type fastener to connect to one another.

Kelly U.S. Pat. No. 6,052,848 discloses an elongated U-shaped pillow which may be of various lengths and the shape of which is easily adjustable for a variety of uses.

Smith U.S. Pat. No. 5,097,551 discloses a segmented, elongated body pillow having a channel through which a user's arm may be received.

Hofstetter U.S. Pat. No. 4,624,021 discloses a cushion-like support for separating the legs of a user while resting and adapted to prevent a user from rolling forward.

Roberts U.S. Pat. No. 4,731,890 is a pillow adapted for use by nursing mothers which pillow is disposed at a right angle and does not adjust to achieve the features of the present invention.

Schaffner U.S. Pat. No. 5,987,674 recites a ergonomic pillow designed accommodate the head and limbs of a user without repositioning of the pillow. The Schaffner pillow is of uniform thickness throughout and specifically obviates repositioning or adjustment of the pillow.

Brownrigg U.S. Pat. No. 6,088,854 appears to be a long thin pillow that can be positioned in a variety of ways, but it appears to be uniform shape throughout and cannot achieve the functionality that is critical to the present invention.

Carter, et al., U.S. Pat. No. 6,708,354B1 recites a dial pillow assembly for use by a nursing mother when lying on her side. This pillow has no central portion similar to that set forth in the present invention.

SUMMARY OF THE INVENTION

An elongated angular multiple position body pillow comprising an enlarged center section having a curved top portion and a substantially straight base, and two arms extending longitudinally from the center section and at an adjustable angle thereto, the pillow having an outer edge and an inner edge, a first arm having a non-terminal end connected to a center section and a terminal end provided with a first half of a tie, a center section having a substantially straight base along the outer edge of the center section and a curved top portion along the inner edge thereof, a second arm having a non-terminal end connected to the center section and a terminal end provided with a second half of a tie, the first arm and second arm being substantially symmetrical, the first and second halves of the ties being adapted to engage each other to secure the pillow in a semi-toroidal shape if desired, the pillow being disposed to lie in a full length substantially flat position when the first and second half of the ties are not engaged. The pillow has a length of approximately eighty (80) inches from the first terminal end of the first arm along the outer edge of the pillow to the second terminal end of the pillow, a length of approximately sixty-eight (68) inches from the first terminal end of the first arm of the pillow along the inner edge of the pillow to the second terminal end, the substantially curved top portion of the center section along the inner edge thereof has a length of approximately thirty (30) inches, and the first arm and second arm have a length of approximately nineteen (19) inches, respectively. The terminal end of the first arm and the terminal end of the second arm have an approximate length of fourteen (14) inches and terminate in a beveled edge, the first arm and the second arm having a width, at the widest points thereof, of seventeen (17) inches, the enlarged center section having a width, at the widest point thereof, of twenty-two (22) inches, the curved top portion of the enlarged center section terminating in a beveled edge. The first arm of the pillow connects to the enlarged center section at the non-terminal end of the first arm at an angle of fifteen (15) to twenty (20) degrees, and the second arm of the pillow connects to the enlarged center section at the non-terminal end of the second arm at an angle of fifteen (15) to twenty (20) degrees when the elongated angular multiple position body pillow is disposed in the full length substantially flat position. The pillow is of sufficient length to accommodate an adult user and is adapted to extend beyond the length of an average adult user to provide full body support when disposed in the full length substantially flat position. When the ties are engaged and the pillow is disposed in the semi-toroidal position, the pillow is adapted to provide elevational support for the back of the user, the legs of the user, or to encircle the waist of the user to create a pillow support for the user and proper positioning for a nursing infant.

The elongated angular multiple position body pillow of the present invention is intended to permit a plurality of positioning options to facilitate cushioning support for an adult user, and particularly a pregnant female user, at various stages of pregnancy and post-pregnancy as a support pillow and a nursing pillow, alternatively. The elongated angular multiple position body pillow may be provided with a removable fabric cover to facilitate ease of laundering. A smaller version of the elongated angular multiple position body pillow, having a reduction in all dimensions by thirty percent (30%) is further contemplated for use by children.

BRIEF DESCRIPTION OF THE DRAWINGS

FIG. 7 is a view similar to FIG. 6 but wherein the pillow has been turned such that the contoured central section of the pillow faces downward (not visible in this embodiment), the tied ends of the first arm and second arm of the pillow are received against the buttocks of a user, and the back of the user is received against the outer portion of the central section.

FIG. 8 is a side perspective view of the elongated angular multiple position body pillow of the present invention wherein the first end and second end of the pillow have been brought together and tied to achieve a semi-toroidal position, the contoured central section of the pillow faces upward and is received against the back of a user in a seated position, such as on a bed, the first end and second end of the pillow being received under the arms of the user, the first and second ends being brought together and tied to achieve a semi-toroidal position at the front of the user, and an infant being received on one arm of the pillow.

DETAILED DESCRIPTION OF THE PREFERRED EMBODIMENTS

Figure 1:
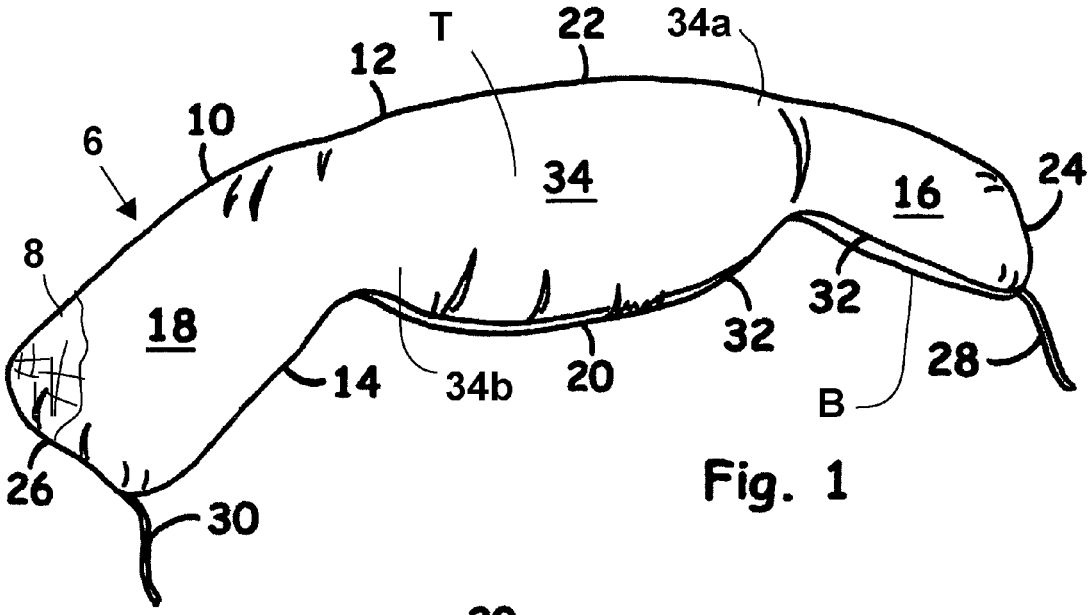
FIG. 1 is a top perspective view showing the elongated angular multiple position body pillow of the present invention in the extended form.

Referring to the drawings in detail, FIG. 1 shows a top perspective view of the elongated angular multiple position body pillow 6. The body pillow 6 comprises a pillow body 10 and preferably also a removable cover 8 (shown only in part). The pillow body 10 comprises a top surface "T" and a bottom surface "B" (see also FIGS. 3 and 4), an outer edge or second side 12, an inner edge or first side 14, a first terminal or free end 24, a second terminal or free end 26, the outer edge 12 having a length of approximately eighty (80) inches from the first terminal end 24 to the second terminal end 26. The pillow body 10 is further comprised of a first arm 16 and a second arm 18, the first arm 16 and second arm 18 each having a terminal or free end, 24 and 26, respectively, and a non-terminal end attaching to the first and second ends 34*a* and 34*b* of an enlarged center section 34 having a curved top-portion 20, where the center section curves outwardly from the first side 14 between the first and second arms 16 and 18, and a substantially straight base 22, the inner edge 14 of the pillow 10 has a length of approximately sixty-eight (68) inches. The first arm 16 and second arm 18 attach to the curved top portion 20 of the enlarged center section 34 at an angle of approximately fifteen (15) to twenty (20) degrees to provide optimal contact with the body of a user (not shown in this figure). The first arm 16 and second arm 18 each have a length of approximately nineteen (19) inches, respectively, the first terminal end 24 of the first arm 16 and the second terminal end 26 of the second arm 18 have an approximate length of fourteen (14) inches and terminate in a beveled edge or seam 32, the first arm 16 and the second arm 18 having a width, at the widest points thereof, of seventeen (17) inches, the enlarged center section 34 has a width, at the widest point thereof, of twenty-two (22) inches, the curved top portion 20 of the enlarged center section 34 along the inner edge thereof has a length of approximately thirty (30) inches and terminates in a beveled edge or seam 32 so as to be comfortably received against the back or torso of a user (not shown in this figure). The first terminal end 24 of the first arm 16 is provided with a first connector such as the tie 28, and the second terminal end 26 of the second arm 18 is provided with a second connector such as the tie 30, the first tie 28 and second tie 30 are adapted to engage each other to secure the pillow body 10 in a semi-toroidal shape if desired (see FIG. 2), the pillow 10 is disposed to lie in a full length substantially flat position, that is, a resting position, when the first tie 28 and second tie 30 are not engaged. The elongated angular multiple position body pillow 10 may be configured for use by a child by reducing the dimensions of the pillow by thirty percent (30%). In the child pillow embodiment, the pillow body 10 comprises a first arm 16 and a second arm 18, the first arm 16 and second arm 18 each having a terminal end, 24 and 26, respectively, and a non-terminal end attaching to the first and second ends 34*a* and 34*b* of an enlarged center section 34 having a curved top portion 20 and a substantially straight base 22, the inner edge 14 of the pillow 10 has a length of approximately forty-eight (48) inches, and an outer edge 12 having a length of approximately sixty (60) inches from the first terminal end 24 to the second terminal end 26. The first arm 16 and second arm 18 attach to the curved top portion 20 of the enlarged center section 34 at an angle of approximately fifteen (15) to twenty (20) degrees to provide optimal contact with the body of a user (not shown in this figure). The first arm 16 and second arm 18 each have a length of approximately fourteen (14) inches, respectively, the first terminal end 24 of the first arm 16 and the second terminal end 26 of the second arm 18 have an approximate length of ten (10) inches and terminate in a beveled edge or seam 32, the first arm 16 and the second arm 18 having a width, at the widest points thereof, of twelve (12) inches, the enlarged center section 34 has a width, at the widest point thereof, of sixteen (16) inches, the curved top portion 20 of the enlarged center section 34 along the inner edge thereof has a length of approximately twenty-one (21) inches and terminates in a beveled edge or seam 32 so as to be comfortably received against the back or torso of a user (not shown in this figure). The first terminal end 24 of the first arm 16 is provided with a first connector such as the tie 28 and the second terminal end 26 of the second arm 18 is provided with a second connector such as the tie 30, the first tie 28 and second tie 30 are adapted to engage each other to secure the pillow body 10 in a semi-toroidal shape if desired (see FIG. 2), the pillow 10 is disposed to lie in a full length substantially flat position when the first tie 28 and second tie 30 are not engaged.

Figure 2:
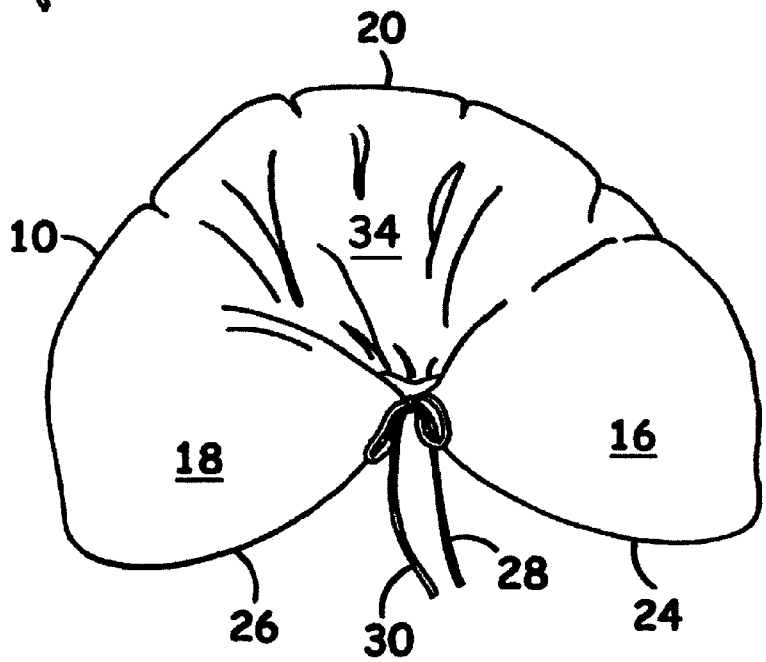
FIG. 2 is a front perspective view of the elongated angular multiple position body pillow of the present invention wherein the arms of the pillow have been brought together and secured by the ties attached at the ends thereof.

FIG. 2 shows the elongated angular multiple position body pillow 10 of the present invention in a semi-toroidal embodiment. The semi-toroidal shape is achieved by drawing the first end 24 of the first arm 16 and the second end 26 of the second arm 18 toward one another until the first end 24 and the second end 26 are adjacent one another and the first tie 28 and second tie 30 are brought into alignment. The first tie 28 and the second tie 30 are adapted to engage each other by tying and, once tied, the pillow 10 is secured in a semi-toroidal shape which can fit around the torso of a user (see FIG. 8) or which can be used to support the user in various positions (see FIGS. 6 and 7). As will hereinafter appear, the pillow 10, engaged in the semi-toroidal position, may be placed with the curved top portion 30 in the uppermost position to provide support to the back of a user (not shown in this figure) or, alternatively, with the substantially straight base 22 in the uppermost position to provide support for the legs of a user (not shown in this figure). When the curved top portion 30 is in the uppermost position, the curved top portion 30 creates a raised elevated angular surface support to accommodate the back of a user as will hereinafter appear. When the substantially straight base 22 is in the uppermost position (see FIG. 7), the substantially straight base 22 provides a flat elevated angular surface to accommodate the back, legs, or torso of the user. The angle achieved by placing the curved top portion 30 in the uppermost position is slightly steeper than the angle achieved by placing the substantially straight base 22 in the uppermost position, thereby providing the user with additional positioning options for optimal comfort.

Figure 3:
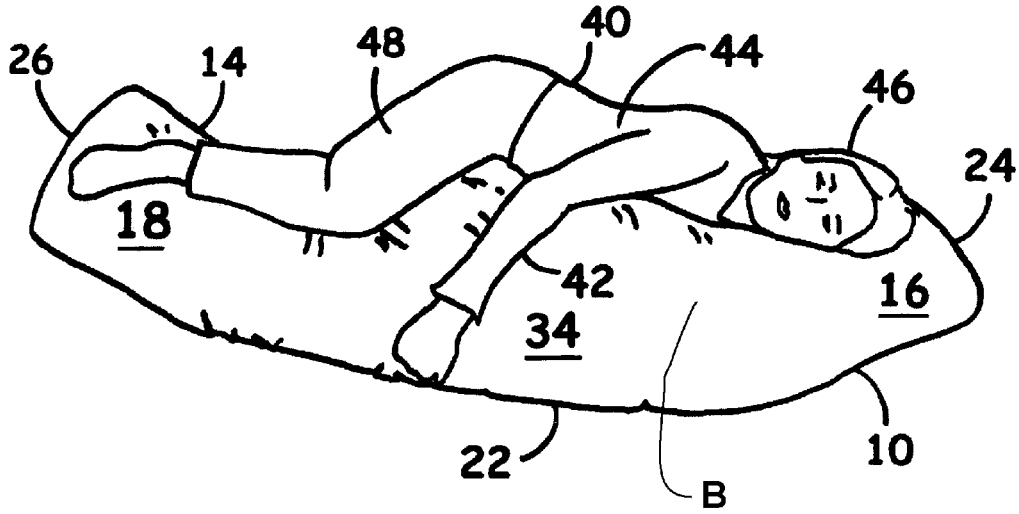
FIG. 3 is a front perspective view of the elongated angular multiple position body pillow of the present invention wherein the contoured central section is received along the front upper torso of a user, the user's head being received on a first arm of the pillow, the user's leg extending across the contoured central section and being received on a second arm of the pillow, and the user's arm being received across the contoured central section of the pillow.

FIG. 3 shows the elongated angular multiple position body pillow 10 of the present invention employed by a female user 40 with the user 40 lying on her side. The curved top portion (not numbered in this figure) of the enlarged center section 34 is received against the torso 44 of the user 40, with the beveled edge or seam (not numbered in this figure) of the curved top portion tucked beneath the torso 44 and belly (not numbered) of the user 40, with the user's head 46 resting on top of the first arm 16, the second arm 18 of the pillow 10 is received between the user's legs 48, and the enlarged center section 34 is received between the user's arms 42. The angle of the first arm 16 and the second arm 18 of the pillow 10 with relation to the enlarged center section 34 are adapted to fit the contours of the user 40 in the extended form.

Figure 4:
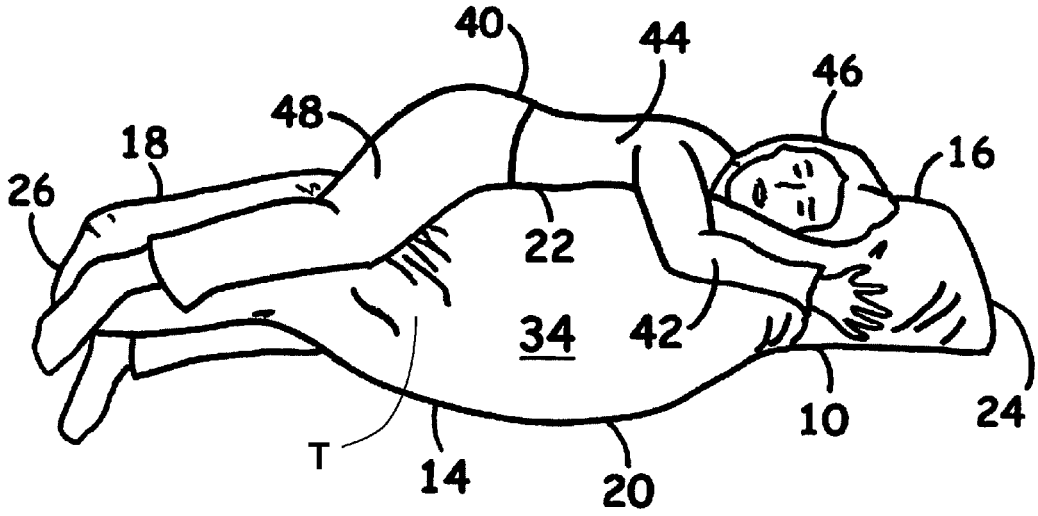
FIG. 4 is a view similar to FIG. 3 but wherein the elongated angular multiple position body pillow of the present invention has been reversed in its position such that the contoured central section faces away from the user and the outer portion of the central section is received against the upper front torso of the user, the user's head being received on a first arm of the pillow, the user's leg extending across the outer portion of the central section and being received on a second arm of the pillow, and the user's arm being received across the first arm of the pillow.

FIG. 4 is a view similar to FIG. 3, except that the elongated angular multiple position body pillow 10 of the present invention is turned such that the curved top portion 20 faces away from the user 40. The substantially straight base (not numbered in this figure) of the enlarged center section 34 is received against the torso 44 of the user 40, with the beveled edge or seam (not numbered in this figure) of the substantially straight base tucked beneath the torso 44 and belly (not numbered) of the user 40, with the user's head 46 resting on top of the first arm 16, the second arm 18 of the pillow 10 is received between the user's legs 48, and the enlarged center section 34 is received between the user's arms 42. In this embodiment, the angle of the first arm 16 and the second arm 18 of the pillow 10 with relation to the enlarged center section 34 may be retained in their original extended position or, alternatively, pulled toward the user 40 to create a sensation of snugness.

Figure 5:
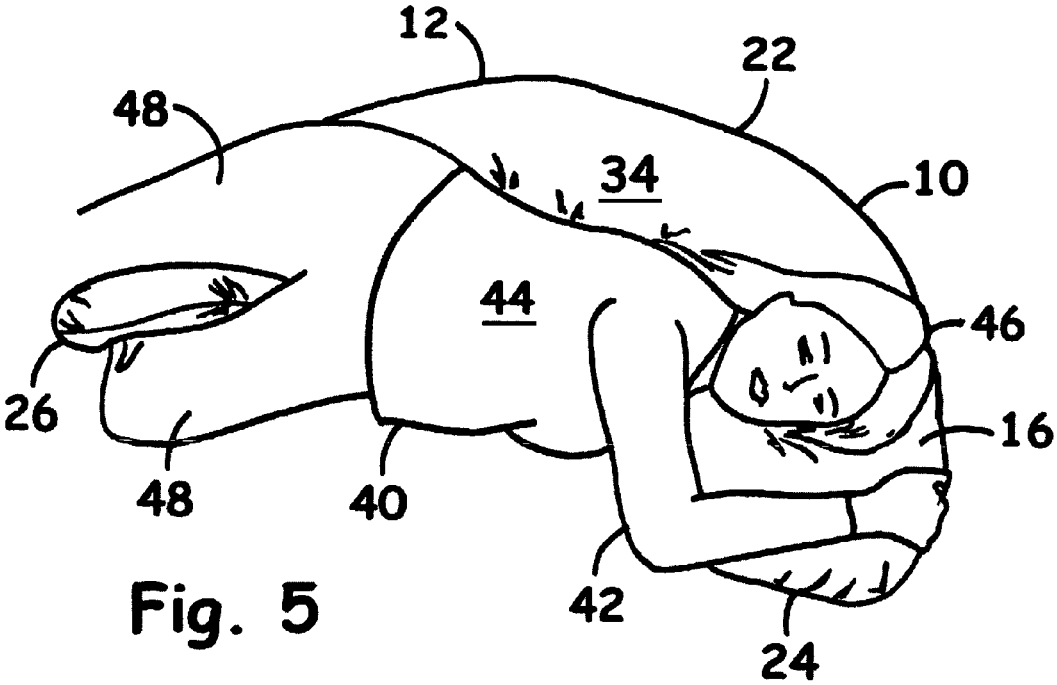
FIG. 5 is a front perspective view of the elongated angular multiple position body pillow of the present invention wherein the contoured central section is received against the back of a user, the user's head being received on a first arm of the pillow, and the second arm of the pillow being received between the legs of the user.

FIG. 5 shows the elongated angular multiple position body pillow 10 of the present invention with the curved top portion (not numbered in this figure) of the enlarged center section 34 received against the back (not numbered) and torso 44 of the user 40 with the beveled edge or seam (not numbered in this figure) of the curved top portion tucked beneath the torso 44 and back of the user 40, with the user's head 46 resting on top of the first arm 16, the second end 26 of the second arm (not numbered in this figure) of the pillow 10 is received between the user's legs 48, and the first end 24 of the first arm 16 is received between the user's arms 42. While the angle of the first arm 16 and the second arm 18 of the pillow 10 with relation to the enlarged center section 34 are adapted to fit the contours of the user 40 in the extended form, by pulling the first arm 16 and the second arm (not numbered in this figure) toward the user 40, the curved top portion of the enlarged center section 34 is caused to be brought into closer contact with the torso 44 of the user 40 to create greater support and a sensation of snugness. By pulling either the first arm 16 or second arm (not numbered in this figure) individually toward the user, a portion of the enlarged center section 34 corresponding with the arm being adjusted will be brought into closer contact with the user's torso 44 independent the arm not being adjusted.

Figure 6:
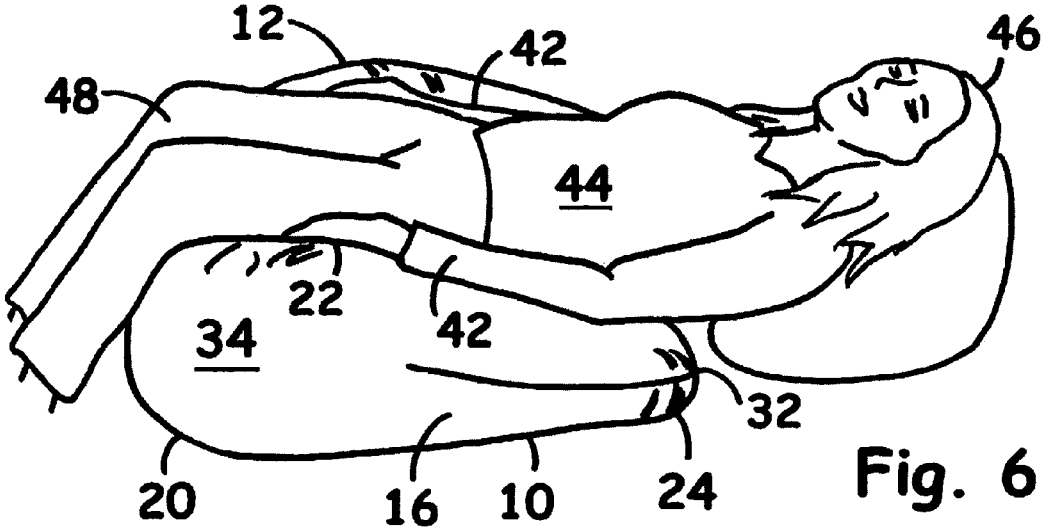
FIG. 6 is a side perspective view of the elongated angular multiple position body pillow of the present invention wherein the first arm and second arm of the pillow have been brought together and tied at their respective ends to achieve a semi-toroidal position, the contoured central section of the pillow faces downward (not visible in this embodiment), the tied ends of the first and second arms of the pillow are received against the buttocks of a user, and the legs of the user are received over the outer portion of the central section.

FIG. 6 shows the elongated angular multiple position body pillow 10 of the present invention in a semi-toroidal embodiment. As set forth in FIG. 2, the semi-toroidal shape is achieved by drawing the first end 24 of the first arm 16 and the second end 26 of the second arm 18 toward one another until the first end 24 and the second end 26 are adjacent one another and the first tie 28 and second tie 30 are brought into alignment. The first tie 28 and the second tie 30 are adapted to engage each other by tying and, once tied, the pillow 10 is secured in a semi-toroidal shape, in this embodiment with the substantially straight base 22 in the uppermost position. The beveled edge or seam 32 along the first end 24 and the second end 26 are received beneath the buttocks (not numbered) and torso 44 of the user 40, with the user's legs 48 extending over the substantially straight base 22 of the enlarged center section 34, the knees (not numbered) of the user 40 being received over the substantially straight base 22 to elevate the user's legs 48 in a bended-knee position. The user's arms 42 rest against the first arm 16 and second arm (not numbered in this figure) of the pillow 10. In this embodiment, the user's head is received on a separate pillow (not numbered) or may alternatively be received on a flat surface.

FIG. 7 shows the elongated angular multiple position body pillow 10 of the present invention in a semi-toroidal embodiment. As set forth in FIG. 2, the semi-toroidal shape is achieved by drawing the first end 24 of the first arm 16 and the second end 26 of the second arm 18 toward one another until the first end 24 and the second end 26 are adjacent one another and the first tie 28 and second tie 30 are brought into alignment. The first tie 28 and the second tie 30 are adapted to engage each other by tying and, once tied, the pillow 10 is secured in a semi-toroidal shape, in this embodiment with the curved top portion 20 in the uppermost position. The beveled edge or seam 32 along the first end 24 and the second end 26 are received beneath the buttocks (not numbered) of the user 40, with the user's torso 44 and arms 42 resting against the first arm 16 and second arm 18 of the pillow 10 and the user's head 46 resting against the curved top portion 20 of the enlarged center section 34, the legs 48 of the user 40 not coming into direct contact with the pillow 10 in this embodiment.

FIG. 8 shows the elongated angular multiple position body pillow 10 of the present invention in a semi-toroidal embodiment. As set forth in FIG. 2, the semi-toroidal shape is achieved by drawing the first end 24 of the first arm 16 and the second end 26 of the second arm 18 toward one another until the first end 24 and the second end 26 are adjacent one another and the first tie 28 and second tie 30 are brought into alignment. The first tie 28 and the second tie 30 are adapted to engage each other by tying and, once tied, the pillow 10 is secured in a semi-toroidal shape, in this embodiment with the curved top portion 20 in the uppermost position. In this embodiment, the torso 44 of the user 40 is received within the well created by the engagement of the first tie 28 with the second tie 30 with the curved top portion 20 of the enlarged center section 34 being received against the back (not numbered) of the user 40 to support her in a seated position. The beveled edge or seam 32 along the first end 24 of the first arm 16 and the second end 26 of the second arm 18 are received beneath the user's arms 42 so as to provide support for an infant 50 in the nursing or cradled position.

While FIGS. 1 through 8, inclusive, depict the various positions which may be achieved with the elongated angular multiple position body pillow of the present invention, it should be apparent that other and further modifications of the present invention, apart from those shown or suggested herein, may be made within the spirit and scope of this invention.

What is claimed is:

1. A body pillow comprising:

an elongate, flexible pillow body sized for use as a body pillow by an adult or child and which in a resting position comprises:

a center section having a first end and a second end;

a first arm having a non-terminal end extending from the first end of the center section and terminating in a first free end of the pillow body; and a second arm having a non-terminal end extending from the second end of the center section and terminating in a second free end of the pillow body;

wherein the length of the center section is greater than the length of each of the first and second arms;

the pillow body having a top surface, a bottom surface, a first side, and a second side;

wherein, in the extended form, the first side defines a single continuous outward curve extending from the first end of the center section to the second end of the center section; and wherein the first and second arms are symmetrically sized, shaped and positioned relative to the center section and are angled toward the first side.

2. The body pillow of claim 1 wherein the curved first side of the center section terminates in a beveled edge.

3. The body pillow of claim 2 wherein each of the first and second free ends of the first and second arms terminates in a beveled edge.

4. The body pillow of claim 3 wherein the first and second arms are at an angle of approximately fifteen (15) to twenty (20) degrees from the center section.

5. The body pillow of claim 4 further comprising a first connector on the free end of the first arm and a second connector on the free end of the second arm, the first and second connectors adapted to engage each other so that pillow body can be pressed into a semi-toroidal position.

6. The body pillow of claim 5 further comprising a removable cover sized to snugly enclose the pillow body.

7. The body pillow of claim 1 wherein each of the first and second free ends of the first and second arms terminates in a beveled edge.

8. The body pillow of claim 1 further comprising a first connector on the free end of the first arm and a second connector on the free end of the second arm, the first and second connectors adapted to engage each other so that pillow body can be pressed into a semi-toroidal position.

9. The body pillow of claim 8 where the first and second connectors are ties.

10. The body pillow of claim 1 further comprising a removable cover sized to snugly enclose the pillow body.

11. The body pillow of claim 1 wherein the first and second arms are at an angle of approximately fifteen (15) to twenty (20) degrees from the center section.

12. The body pillow of claim 1 wherein the second side has a length of approximately eighty (80) inches and the first side has a length of approximately sixty-eight (68) inches, wherein the length of the center section along the first side is approximately thirty (30) inches, wherein the length of each of the first and second arms along the first side is approximately nineteen (19) inches, wherein the width of the first and second arms at the widest point thereof is approximately seventeen (17) inches, and wherein the width of the center section at the widest point thereof is approximately twenty-two (22) inches.

13. The body pillow of claim 1 wherein the second side has a length of approximately sixty (60) inches and the first side has a length of approximately forty-eight (48) inches, wherein the length of the center section along the first side is approximately twenty-one (21) inches, wherein the length of each of the first and second arms along the first side is approximately fourteen (14) inches, wherein the width of the first and second arms at the widest point thereof is approximately twelve (12) inches, and wherein the width of the center section at the widest point thereof is approximately sixteen (16) inches.

14. A body pillow comprising:

an elongate, flexible pillow body sized for use as a body pillow by an adult or child and which in a resting position comprises:

a center section having a first end and a second end;

a first arm having a non-terminal end extending from the first end of the center section and terminating in a first free end of the pillow body; and a second arm having a non-terminal end extending from the second end of the center section and terminating in a second free end of the pillow body;

wherein the length of the center section is greater than the length of each of the first and second arms;

the pillow body having a top surface, a bottom surface, a first side, and a second side;

wherein, in the extended form, the first side defines a single continuous outward curve extending from the first end of the center section to the second end of the center section; and wherein the first and second arms are symmetrically sized, shaped and positioned relative to the center section and are angled relative to the center section at about fifteen (15) to about twenty (20) degrees.

15. The body pillow of claim 14 wherein the curved first side of the center section terminates in a beveled edge.

16. The body pillow of claim 15 wherein each of the first and second free ends of the first and second arms terminates in a beveled edge.

17. The body pillow of claim 16 further comprising a first connector on the free end of the first arm and a second connector on the free end of the second arm, the first and second connectors adapted to engage each other so that pillow body can be pressed into a semi-toroidal position.

18. The body pillow of claim 17 further comprising a removable cover sized to snugly enclose the pillow body.

19. The body pillow of claim 14 wherein each of the first and second free ends of the first and second arms terminates in a beveled edge.

20. The body pillow of claim 14 further comprising a first connector on the free end of the first arm and a second connector on the free end of the second arm, the first and second connectors adapted to engage each other so that pillow body can be pressed into a semi-toroidal position.

21. The body pillow of claim 20 where the first and second connectors are ties.

22. The body pillow of claim 14 further comprising a removable cover sized to snugly enclose the pillow body.

23. The body pillow of claim 14 wherein the second side has a length of approximately eighty (80) inches and the first side has a length of approximately sixty-eight (68) inches, wherein the length of the center section along the first side is approximately thirty (30) inches, wherein the length of each of the first and second arms along the first side is approximately nineteen (19) inches, wherein the width of the first and second arms at the widest point thereof is approximately seventeen (17) inches, and wherein the width of the center section at the widest point thereof is approximately twenty-two (22) inches.

24. The body pillow of claim 14 wherein the second side has a length of approximately sixty (60) inches and the first side has a length of approximately forty-eight (48) inches, wherein the length of the center section along the first side is approximately twenty-one (21) inches, wherein the length of each of the first and second arms along the first side is approximately fourteen (14) inches, wherein the width of the first and second arms at the widest point thereof is approximately twelve (12) inches, and wherein the width of the center section at the widest point thereof is approximately sixteen (16) inches.

25. The body pillow of claim 1 wherein the length of the center section is approximately fifty percent greater than the length of each of the arms.

26. The body pillow of claim 14 the length of the center section is approximately fifty percent greater than the length of each of the arms.

* * * * *